US007066130B2

(12) United States Patent
Purdy et al.

(10) Patent No.: US 7,066,130 B2
(45) Date of Patent: Jun. 27, 2006

(54) RECOIL STARTER WITH AUTOMATIC ORIENTATION

(75) Inventors: Michael A. Purdy, Oshkosh, WI (US); Mark T. Lokken, Oshkosh, WI (US); Koichiro Takahashi, Tokyo (JP)

(73) Assignees: Tohatsu Corporation, Tokyo (JP); Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/992,519

(22) Filed: Nov. 18, 2004

(65) Prior Publication Data

US 2006/0102129 A1 May 18, 2006

(51) Int. Cl.
*F02N 1/00* (2006.01)

(52) U.S. Cl. ..... 123/185.3; 440/77

(58) Field of Classification Search ..... 123/185.2, 123/185.3; 440/77, 85
See application file for complete search history.

(56) References Cited

U.S. PATENT DOCUMENTS

| | | | | |
|---|---|---|---|---|
| 4,019,490 | A | 4/1977 | Reese | |
| 4,103,660 | A | 8/1978 | Reese | |
| 4,348,194 | A * | 9/1982 | Walsh | 440/77 |
| 5,256,091 | A * | 10/1993 | Haman et al. | 440/85 |
| 5,984,742 | A * | 11/1999 | Kimura et al. | 440/77 |
| 6,428,373 | B1 * | 8/2002 | Ikuma et al. | 440/77 |

* cited by examiner

*Primary Examiner*—Henry C. Yuen
*Assistant Examiner*—Arnold Castro
(74) *Attorney, Agent, or Firm*—Andrus, Sceales, Starke & Sawall, LLP

(57) ABSTRACT

A recoil starter has a guide surface with limited polar symmetry about the axis of the pull-rope limiting rotational orientation of the pull-handle in the at-rest position to less than three angular positions.

32 Claims, 5 Drawing Sheets

RECOIL STARTER WITH AUTOMATIC ORIENTATION

BACKGROUND AND SUMMARY

The invention relates to motors having an internal combustion engine with a recoil starter, and more particularly to automatic orientation of the pull-handle.

Motors having internal combustion engines with recoil starters are known. A pull-rope extends through an opening in a recoil starter housing and is connected to a pull-handle having an at-rest translational position seated against the opening, and is pullable away therefrom for starting the engine, followed by recoil return thereof to the at-rest translational position. In various applications, including some marine outboard motors, it may be desirable to provide automatic keyed orientation of the pull-handle at the end of the rope upon recoil return so that the pull-handle is out of the way of other components. For example, in some outboard motor applications, the top cowl can only be removed when the recoil starter pull-handle is in a horizontal orientation. In this instance, the user must re-orient the handle, if needed, to a horizontal position every time he/she removes the top cowl. In other applications, the appearance of the outboard motor is considered improved when the pull-handle returns and remains in the same horizontal orientation. In other applications, and responsive to customer preference, starting the outboard motor is more convenient when the pull-handle is consistently oriented in the same angular position.

The present invention provides a simple and effective solution satisfying the above noted criteria.

DETAILED DESCRIPTION

Figure 1:
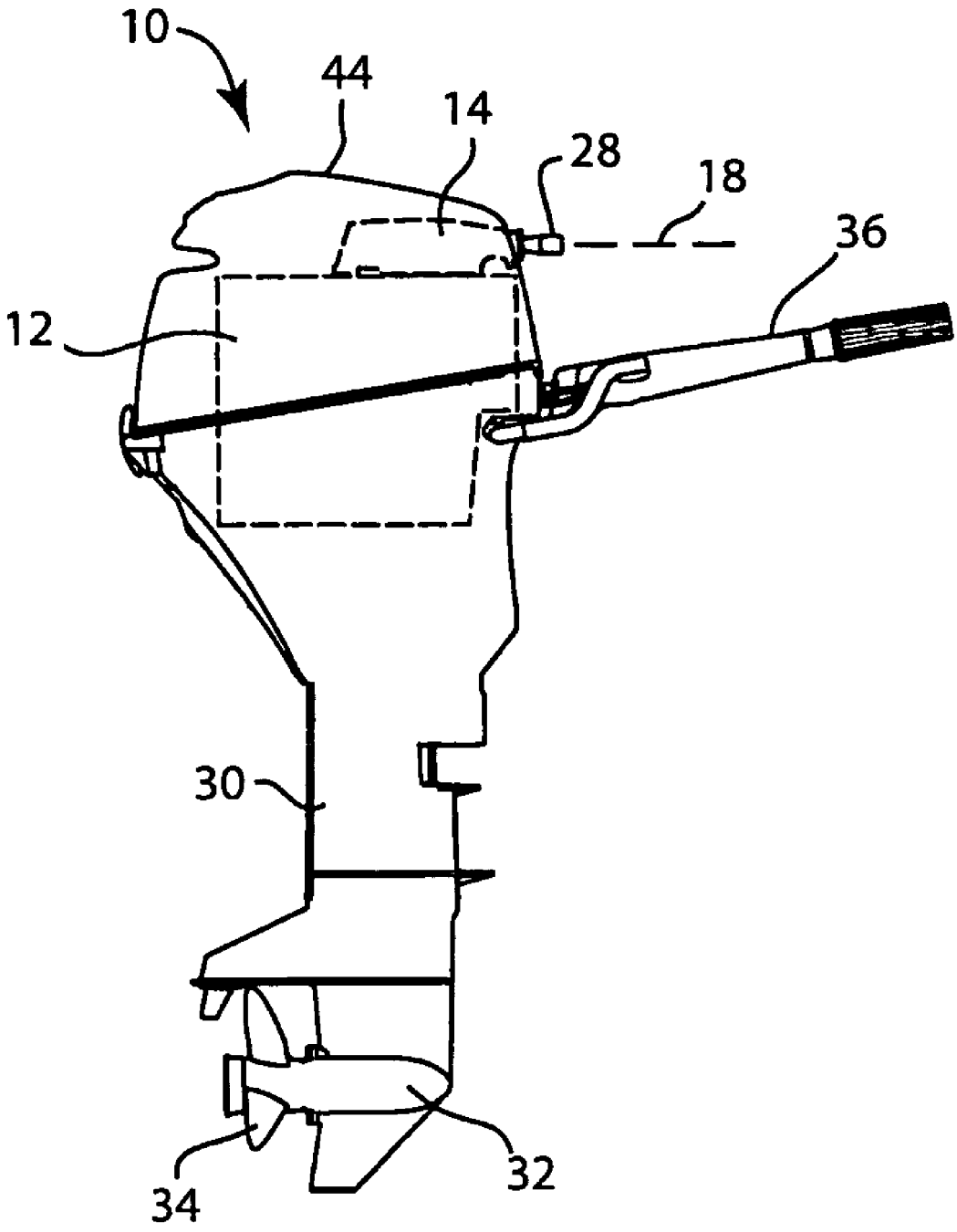
FIG. 1 is a side profile view of a marine outboard motor.
Figure 2:
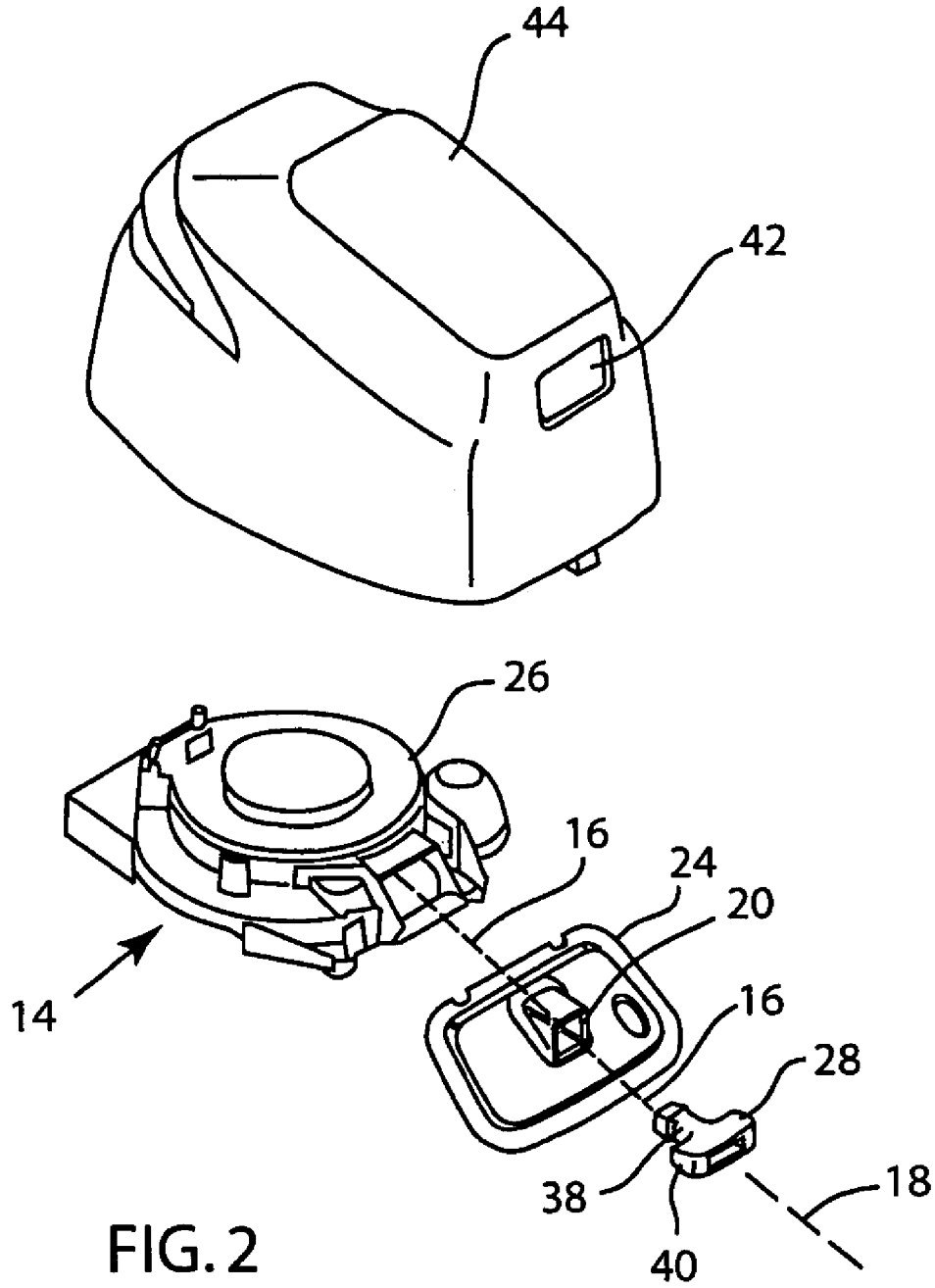
FIG. 2 PRIOR ART
FIG. 2 is an exploded perspective view of a portion of FIG. 1, illustrating prior art.

FIGS. 1 and 2 show a marine outboard motor 10 having an internal combustion engine 12 with a recoil starter 14 having a pull-rope 16 extending axially along an axis 18 through an opening 20 in a faceplate 24 of recoil starter housing 26. The pull-rope 16 is connected to a pull-handle 28 having an at-rest translational position, FIG. 1, seated against opening 20, and being pullable away therefrom (rightwardly in FIGS. 1, 2) for starting engine 12, followed by recoil return of handle 28 to the at-rest translational position shown in FIG. 1, all as is known. Outboard motor 10 has a downwardly depending driveshaft housing 30 with a lower torpedo housing 32 and propeller 34. The motor has a forwardly extending tiller handle 36 for various control functions, including steering.

It is known in the prior art to provide opening 20 as a four-sided square pocket extending into the recoil starter housing and having female camming surfaces tapered relative to axis 18, and to provide the pull-handle extending into such pocket and having complemental male camming surfaces tapered relative to axis 18, such that the noted camming surfaces provide guide surfaces cammingly engaging each other during recoil return of the pull-handle to the at-rest translational position to guide and limit the pull-handle to one of four angular positions or orientations of the T-shaped handle, two of which positions are vertical and two of which are horizontal. It is also known to provide opening 20 as a round pocket extending into the recoil starter housing and having female surfaces tapered relative to axis 18. The round design is considered undesirable because it allows the pull-handle to rotate about axis 18 during operation, due to the vibration produced by engine 12. This rotation or spinning while the outboard motor is running causes surface wear of the mating surfaces of the handle and pocket. The square design of pocket 20 is thus preferred.

Pull-handle 28 is a T-shaped member having a central stem 38 extending axially along axis 18 and having a crossbar 40 extending laterally across the central stem transversely to axis 18 and being grippable by the user's hand. In the noted at-rest position, the pull-handle extends through opening 42 in upper cowl 44 which encloses the engine. To remove the cowl, pull-handle 28 must be in one of the noted two horizontal positions of crossbar 40, and, if not, the user must re-orient the pull-handle from one of the noted vertical positions of crossbar 40 to one of the horizontal positions of crossbar 40, to allow clearance of cowl opening 42 past crossbar 40.

FIGS. 3–11 illustrate the present invention, and use like reference numerals from above where appropriate to facilitate understanding.

Figure 3:
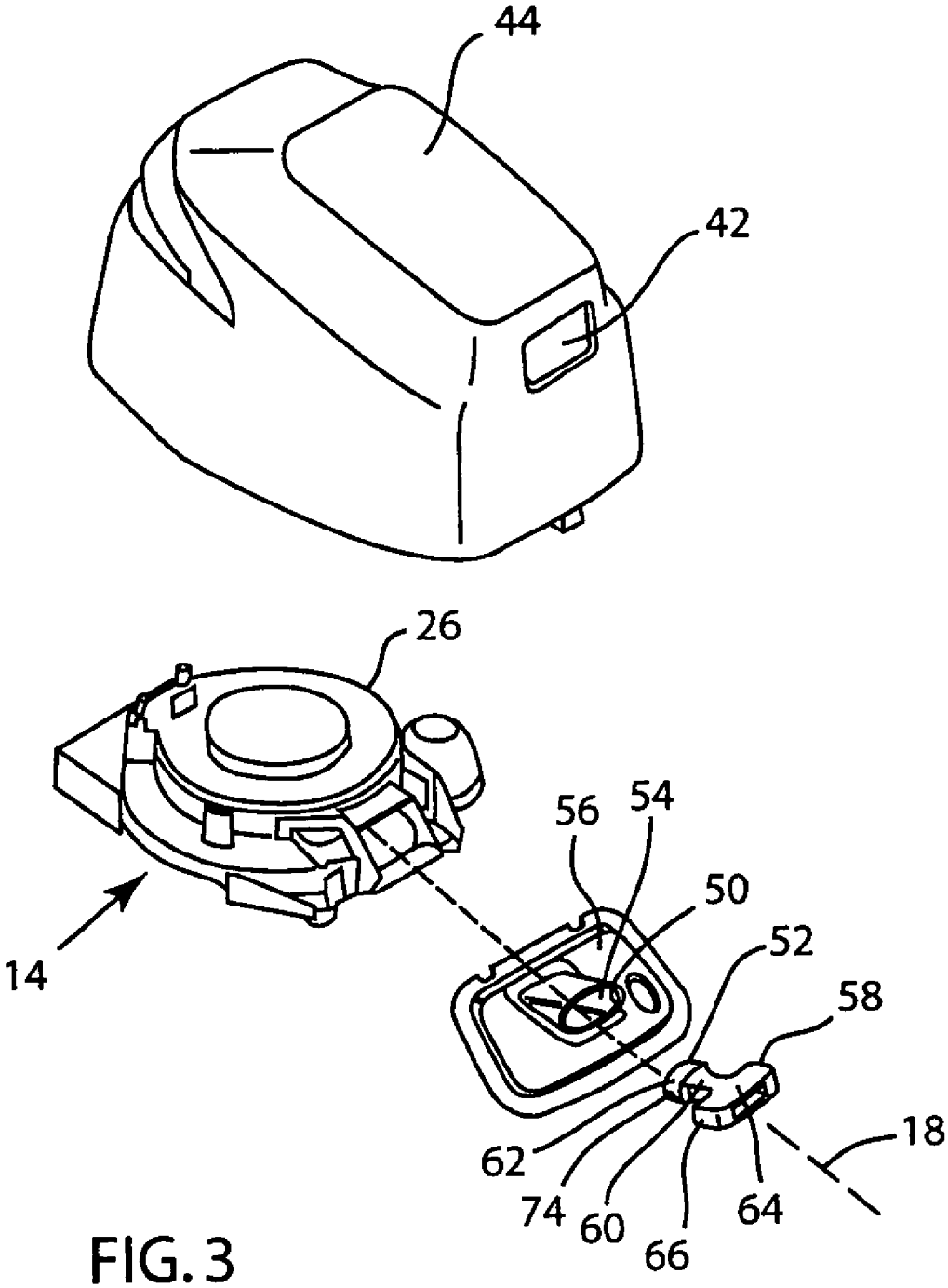
FIG. 3 is like FIG. 2 and shows the present invention.

A guide surface 50 and/or 52, FIG. 3, is formed along at least one of opening 54 of faceplate 56 of recoil starter housing 26 and pull-handle 58 and engages the other of such opening and such pull-handle in the noted at-rest translational position, FIG. 1. The guide surface 50 and/or 52 has limited polar symmetry about axis 18 limiting the rotational orientation of pull-handle 58 in the at-rest translational position to less than three angular positions, preferably exactly two such angular positions. Pull-handle 58 is a T-shaped member having a central stem 60 extending axially along axis 18 and having first and second distally opposite ends 62 and 64. First end 62 is seated against opening 54 in the at-rest translational position, FIG. 1. T-shaped member 58 has a crossbar 66 extending laterally across second end 64 of central stem 60 transversely to axis 18 and is grippable by a user's hand. Each of the noted exactly two angular positions is a horizontal position of crossbar 66 out of the way of opening 42 of cowl 44, and allowing clearance of opening 42 past pull-handle 58 including crossbar 66 upon removal of cowl 44, without having to re-orient pull-handle 58. The two horizontal angular positions of crossbar 66 of pull-handle 58 are 180° apart.

Figure 4:
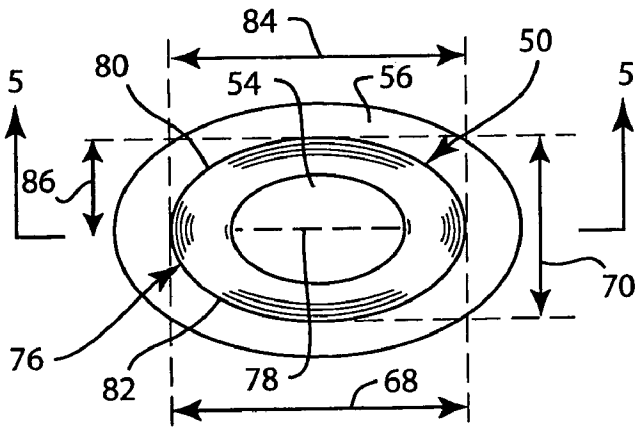
FIG. 4 is a front elevation view of a portion of FIG. 3.

Guide surface 50, FIG. 3, has a cross-sectional shape, FIG. 4, along a lateral plane transverse to axis 18, which cross-sectional shape has a major lateral dimension 68 along a major lateral axis thereacross (left-right in FIG. 4), and a minor lateral dimension 70 along a minor lateral axis thereacross (up-down in FIG. 4). Major lateral dimension 68 is greater than minor lateral dimension 70 and provides keyed orientation of pull-handle 58 to the noted less than three angular positions, namely the noted two angular positions. In FIG. 4, the noted cross-sectional shape is an oval.

Figure 5:
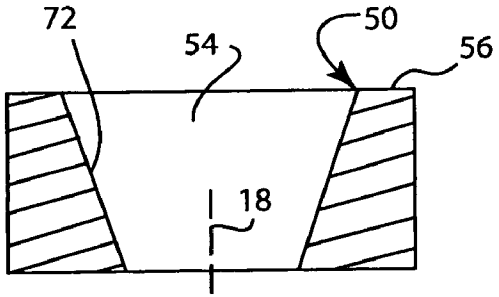
FIG. 5 is a sectional view taken along line 5—5 of FIG. 4.

Opening 54 provides a pocket extending into the recoil starter housing and has female camming surfaces 72, FIG. 5, tapered relative to axis 18 and providing the noted guide surface 50. Further in the preferred embodiment, pull-handle 58 extends into opening 54 and has male camming surfaces 74 tapered relative to axis 18 and also providing a guide surface. The first and second guide surfaces provided respectively by camming surfaces 72 and 74 cammingly engage each other during recoil return of pull-handle 58 to the at-rest translational position of FIG. 1 and guide and limit pull-handle 58 to one of the noted horizontal angular positions of crossbar 66.

Guide surface 50 and/or 52, provided respectively by camming surface 72 and/or 74, defines a perimeter about axis 18, as shown at perimeter 76, FIG. 4. Perimeter 76 is diametrically symmetric about a designated diameter 78 through axis 18 to provide first and second perimeter portions 80 and 82 which are mirror images of each other about diameter 78. Each mirror image 80 and 82 has a first width 84 parallel to diameter 78, and a second width 86 transverse thereto. First width 84 is greater than second width 86 to provide the noted two angular positions in the noted at-rest translational position of pull-handle 58.

Figure 8:
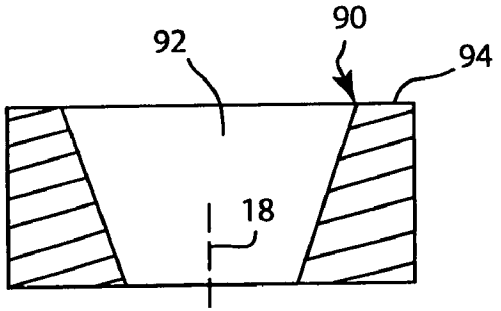
FIG. 8 is a sectional view taken along line 8—8 of FIG. 7.
Figure 7:
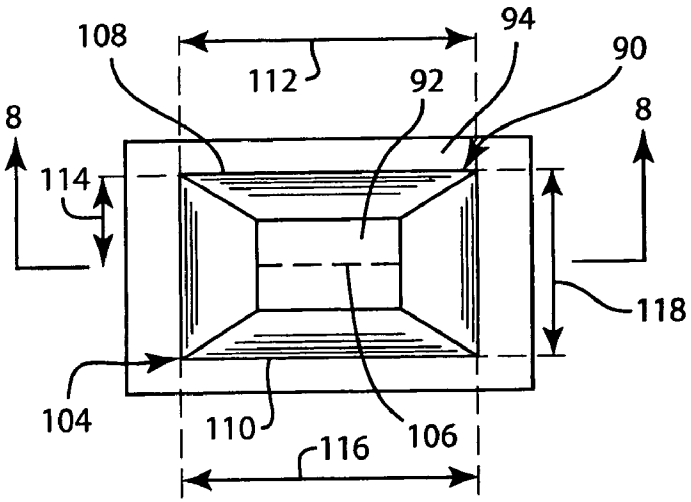
FIG. 7 is a front elevation view of a portion of FIG. 6.
Figure 6:
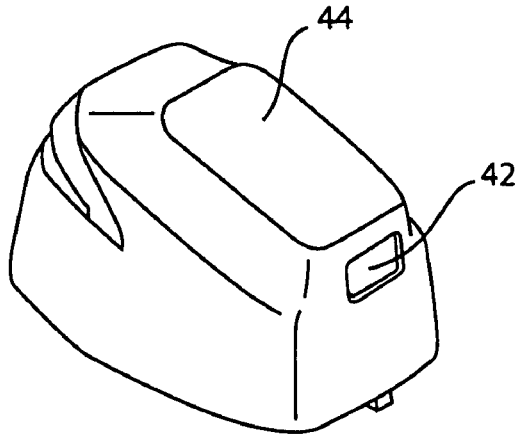
FIG. 6 is like FIG. 3 and shows an alternate embodiment.
Figure 6:
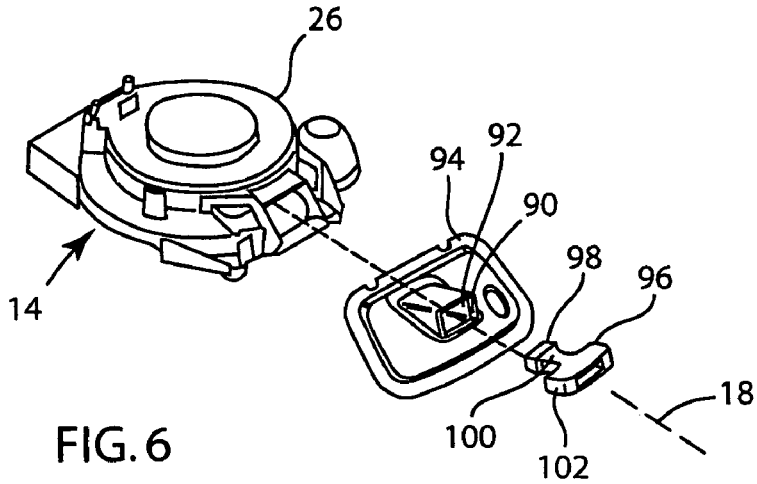
Figure 9:
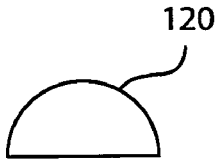
FIG. 9 is a schematic front elevation view of a portion of FIG. 3 and shows an alternate embodiment.
Figure 10:
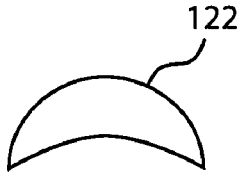
FIG. 10 is like FIG. 9 and shows a further embodiment.
Figure 11:
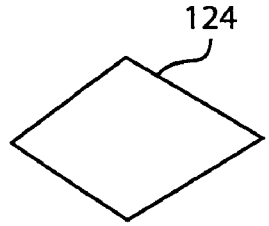
FIG. 11 is like FIG. 9 and shows a further embodiment.

FIGS. 6–8 show an alternate embodiment and use like reference numerals from above where appropriate to facilitate understanding. Guide surface 90 of opening 92 of faceplate 94 of recoil starter housing 26 has a cross-sectional shape which is a rectangle, FIG. 7, instead of an oval. Pull-handle 96 has a guide surface 98 at the inner end of central stem 100 which is complementally rectangular to surface 90 and cammingly received therein, to guide and limit pull-handle 96 to one of the noted two angular horizontal positions of crossbar 102. Guide surfaces 90 and 98 have the above noted limited polar symmetry about axis 18 limiting the rotational orientation of pull-handle 96 in the at-rest translational position to less than three angular positions, as above. The guide surfaces define a perimeter 104 about axis 18, which perimeter is diametrically symmetric about a designated diameter such as 106 to provide first and second mirror image perimeter portions 108 and 110, each mirror image portion having a first width 112 parallel to diameter 106, and a second width 114 transverse thereto, the first width 112 being greater than the second width 114 to provide the noted two angular positions in the at-rest translational position of pull-handle 96. The guide surfaces have cross-sectional shapes along a lateral plane transverse to axis 18, which cross-sectional shape has a major lateral dimension 116 along a major lateral axis thereacross (left-right in FIG. 7), and a minor lateral dimension 118 along a minor lateral axis thereacross (up-down in FIG. 7). Major lateral dimension 116 is greater than minor lateral dimension 118 and provides the noted keyed orientation of pull-handle 96 to the noted two horizontal angular positions of crossbar 102, to afford clearance therepast of opening 42 of cowl 44 for removal of the latter without having to re-orient pull-handle 96.

It is recognized that various equivalents, alternatives and modifications are possible within the scope of the appended claims. For example, the noted guide surfaces and/or openings may have other shapes and configurations, such as: a half moon or semi-circular shape 120, FIG. 9; a crescent moon or banana shape 122, FIG. 10; an elongated diamond shape 124, FIG. 11; and others. It is preferred, and considered a desirable feature, that the present designs continue to enable the above noted anti-rotation feature of the prior art, FIG. 2, preventing rotation of the pull-handle around axis 18 while the motor is running.

What is claimed is:

1. A motor having an internal combustion engine with a recoil starter having a pull-rope extending axially along an axis through an opening in a recoil starter housing, said pull-rope being connected to a pull-handle having an at-rest translational position seated against said opening, and being pullable away therefrom for starting said engine, followed by recoil return thereof to said at-rest translational position, a guide surface formed along at least one of said opening and said pull-handle and engaging the other of said opening and said pull-handle in said at-rest translational position, said guide surface having limited polar symmetry about said axis limiting the rotational orientation of said pull-handle in said at-rest translational position to less than three angular positions.

2. The motor according to claim 1 consisting of exactly two said angular positions.

3. The motor according to claim 2 further comprising an upper cowl above said pull-handle in said at-rest translational position, said pull-handle comprising a T-shaped member having a central stem extending axially along said axis and having first and second distally opposite ends, said first end of said central stem being seated against said opening in said at-rest translational position, said T-shaped member having a crossbar extending laterally across said second end of said central stem transversely to said axis and being gripable by a user's hand, each of said exactly two angular positions being a horizontal position of said crossbar out of the way of said cowl and 180° apart.

4. The motor according to claim 1 wherein said guide surface has a cross-sectional shape along a lateral plane transverse to said axis, said cross-sectional shape having a major lateral dimension along a major lateral axis thereacross, and a minor lateral dimension along a minor lateral axis thereacross, said major lateral dimension being greater than said minor lateral dimension and providing keyed orientation of said pull-handle to said less than three angular positions.

5. The motor according to claim 4 wherein said cross-sectional shape is an oval.

6. The motor according to claim 4 wherein said cross-sectional shape is a rectangle.

7. The motor according to claim 4 wherein said opening comprises a pocket extending into said recoil starter housing and having female caming surfaces tapered relative to said axis of said pull-rope and providing said guide surface.

8. The motor according to claim 4 wherein said pull-handle extends into said opening and has male caming surfaces tapered relative to said axis of said pull-rope and providing said guide surface.

9. The motor according to claim 1 wherein:

said opening comprises a pocket extending into said recoil starter housing and having female caming surfaces tapered relative to said axis and providing a first said guide surface;

said pull-handle extends into said pocket and has male caming surfaces tapered relative to said axis and providing a second said guide surface; and said first and second guide surfaces cammingly engage each other during said recoil return of said pull-handle to said at-rest translational position and guide and limit said pull-handle to one of said less than three angular positions.

10. The motor according to claim 1 wherein:

said guide surface defines a perimeter about said axis;

said perimeter is diametrically symmetric about a designated diameter through said axis to provide first and second perimeter portions which are mirror images of each other about said diameter;

each said mirror image has a first width parallel to said diameter and a second width transverse thereto; and said first width is greater than said second width to provide said less than three angular positions in said at-rest translational position of said pull-handle.

11. The motor according to claim 1 wherein said guide surface has a cross-sectional designated shape along a lateral plane transverse to said axis and providing keyed orientation of said pull-handle to said less than three angular positions.

12. The motor according to claim 11 wherein said designated shape is an oval.

13. The motor according to claim 11 wherein said designated shape is a rectangle.

14. The motor according to claim 11 wherein said designated shape is a half moon or semi-circle.

15. The motor according to claim 11 wherein said designated shape is a crescent moon or banana shape.

16. The motor according to claim 11 wherein said designated shape is an elongated diamond shape.

17. A recoil starter housing and pull-handle combination for a motor having an internal combustion engine with a recoil starter having a pull-rope extending axially along an axis through an opening in a recoil starter housing, said pull-rope being connected to a pull-handle having an at-rest translational position seated against said opening, and being pullable away therefrom for starting said engine, followed by recoil return thereof to said at-rest translational position, a guide surface formed along at least one of said opening and said pull-handle and engaging the other of said opening and said pull-handle in said at-rest translational position, said guide surface having limited polar symmetry about said axis limiting the rotational orientation of said pull-handle in said at-rest translational position to less than three angular positions.

18. The recoil starter housing and pull-handle combination according to claim 17 consisting of exactly two said angular positions.

19. The recoil starter housing and pull-handle combination according to claim 17 wherein said guide surface has a cross-sectional shape along a lateral plane transverse to said axis, said cross-sectional shape having a major lateral dimension along a major lateral axis thereacross, and a minor lateral dimension along a minor lateral axis thereacross, said major lateral dimension being greater than said minor lateral dimension and providing keyed orientation of said pull-handle to said less than three angular positions.

20. The recoil starter housing and pull-handle combination according to claim 19 wherein said cross-sectional shape is an oval.

21. The recoil starter housing and pull-handle combination according to claim 20 wherein said cross-sectional shape is a rectangle.

22. The recoil starter housing and pull-handle combination according to claim 20 wherein said opening comprises a pocket extending into said recoil starter housing and having female caming surfaces tapered relative to said axis of said pull-rope and providing said guide surface.

23. The recoil starter housing and pull-handle combination according to claim 20 wherein said pull-handle extends into said opening and has male caming surfaces tapered relative to said axis of said pull-rope and providing said guide surface.

24. The recoil starter housing and pull-handle combination according to claim 17 wherein:

said opening comprises a pocket extending into said recoil starter housing and having female caming surfaces tapered relative to said axis and providing a first said guide surface;

said pull-handle extends into said pocket and has male caming surfaces tapered relative to said axis and providing a second said guide surface; and said first and second guide surfaces camingly engage each other during said recoil return of said pull-handle to said at-rest translational position and guide and limit said pull-handle to one of said less than three angular positions.

25. The recoil starter housing and pull-handle combination according to claim 17 wherein:

said guide surface defines a perimeter about said axis;

said perimeter is diametrically symmetric about a designated diameter through said axis to provide first and second perimeter portions which are mirror images of each other about said diameter;

each said mirror image has a first width parallel to said diameter and a second width transverse thereto; and said first width is greater than said second width to provide said less than three angular positions in said at-rest translational position of said pull-handle.

26. The recoil starter housing and pull-handle combination according to claim 17 wherein said guide surface has a cross-sectional designated shape along a lateral plane transverse to said axis and providing keyed orientation of said pull-handle to said less than three angular positions.

27. The recoil starter housing and pull-handle combination according to claim 26 wherein said designated shape is an oval.

28. The recoil starter housing and pull-handle combination according to claim 26 wherein said designated shape is a rectangle.

29. The recoil starter housing and pull-handle combination according to claim 26 wherein said designated shape is a half moon or semi-circle.

30. The recoil starter housing and pull-handle combination according to claim 26 wherein said designated shape is a crescent moon or banana shape.

31. The recoil starter housing and pull-handle combination according to claim 26 wherein said designated shape is an elongated diamond shape.

32. A recoil starter housing and pull-handle combination for a motor having an internal combustion engine with a recoil starter having a pull-rope extending axially along a rope axis through an opening in a recoil starter housing, said rope being connected to a pull-handle having an at-rest translational position seated against said opening, and being pullable away therefrom for starting said engine, followed by recoil return thereof to said at-rest translational position, a guide surface formed along at least one of said opening and said pull-handle and engaging the other of said opening and said pull-handle in said at-rest translational position, said guide surface having a cross-sectional shape along a lateral plane transverse to said rope axis, said cross-sectional shape having a major lateral dimension along a major lateral axis thereacross, and a minor lateral dimension along a minor lateral axis thereacross, said major lateral dimension being greater than said minor lateral dimension and providing keyed orientation of said pull-handle in said at-rest translational position.

* * * * *